US010859974B2

(12) United States Patent
Nakamoto

(10) Patent No.: US 10,859,974 B2
(45) Date of Patent: Dec. 8, 2020

(54) SHEET DISCHARGE TRAY HAVING AN AIR CLEANER

(71) Applicant: KYOCERA Document Solutions Inc., Osaka (JP)

(72) Inventor: Fumito Nakamoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 139 days.

(21) Appl. No.: 16/030,958

(22) Filed: Jul. 10, 2018

(65) Prior Publication Data

US 2019/0025756 A1 Jan. 24, 2019

(30) Foreign Application Priority Data

Jul. 20, 2017 (JP) ..... 2017-141262

(51) Int. Cl.
*G03G 21/20* (2006.01)
*G03G 15/00* (2006.01)

(52) U.S. Cl.
CPC ..... *G03G 21/206* (2013.01); *G03G 15/6552* (2013.01); *B65H 2801/06* (2013.01); *G03G 2221/1645* (2013.01)

(58) Field of Classification Search
CPC ..... G03G 21/206; G03G 15/6552; G03G 2221/1645; B65H 2801/06
See application file for complete search history.

(56) References Cited

U.S. PATENT DOCUMENTS 6,094,549 A * 7/2000 Hiraoka ..... G03G 15/2064 399/325
8,228,513 B2 * 7/2012 Saito ..... B65H 31/02 358/1.12
2013/0236228 A1 * 9/2013 Nagasako ..... G03G 15/6552 399/405
2016/0320749 A1 * 11/2016 Komatsuzaki ..... G03G 15/6552

FOREIGN PATENT DOCUMENTS

JP 2012-078520 4/2012

* cited by examiner

*Primary Examiner* — Jennifer E Simmons
*Assistant Examiner* — Quang X Nguyen
(74) *Attorney, Agent, or Firm* — Wenderoth, Lind & Ponack, L.L.P.

(57) ABSTRACT

A sheet discharge tray includes a duct part provided at an upper side of the tray body to form a sheet discharge path communicating with the sheet discharge port and formed in the lower surface thereof with a discharge port that discharges a sheet, a suction fan provided in the duct part to suck air in the image forming apparatus body through the sheet discharge port and to discharge the air from an end part of the duct part, which is opposite to a side of the image forming apparatus body, and a deodorization filter provided in the duct part.

6 Claims, 6 Drawing Sheets

SHEET DISCHARGE TRAY HAVING AN AIR CLEANER

CROSS-REFERENCE TO RELATED APPLICATION

This application is based upon and claims the benefit of priority from Japanese Patent Application No. 2017-141262 filed on Jul. 20, 2017, the entire contents of which are incorporated herein by reference.

BACKGROUND

The technology of the present disclosure relates to a sheet discharge tray.

In an image forming apparatus such as a facsimile, a printer, and a copy machine, since a resin component and the like blended in toner are heated at a high temperature in a fixing device and are evaporated, a volatile organic compound (hereinafter, referred also to as "VOC") is generated. Furthermore, in an image forming apparatus including a corona charging type charging device, oxygen in the air is ionized and ozone is generated. There is a problem that an odor of the VOC and the ozone may give discomfort to a person.

In this regard, there is a case where an air cleaner for removing the odor of the VOC and the like is provided in an apparatus body of an image forming apparatus. In the image forming apparatus, a discharge duct is provided therein with a heating means capable of heating gas containing the VOC and the ozone, and a ultraviolet irradiation means capable of irradiating ultraviolet rays to the gas.

SUMMARY

A sheet discharge tray according to one aspect of the present disclosure includes a tray body. The tray body is mounted at a side surface of an image forming apparatus body and accepts a sheet discharged from a sheet discharge port formed in the side surface.

The present image forming apparatus includes a duct part, a suction fan, and a deodorization filter. The duct part is provided at an upper side of the tray body to form a sheet discharge path communicating with the aforementioned sheet discharge port. In a lower surface of the duct part, a discharge port is formed to discharge a sheet. The suction fan is provided in the duct part. The suction fan sucks air in the image forming apparatus body through the sheet discharge port and discharges the air from an end part of the duct part, which is opposite to the aforementioned image forming apparatus body side. The deodorization filter is provided in the duct part.

DETAILED DESCRIPTION

Hereinafter, an example of an embodiment will be described in detail on the basis of the drawings. It is noted that the technology of the present disclosure is not limited to the following embodiments.

Embodiment

Figure 1:
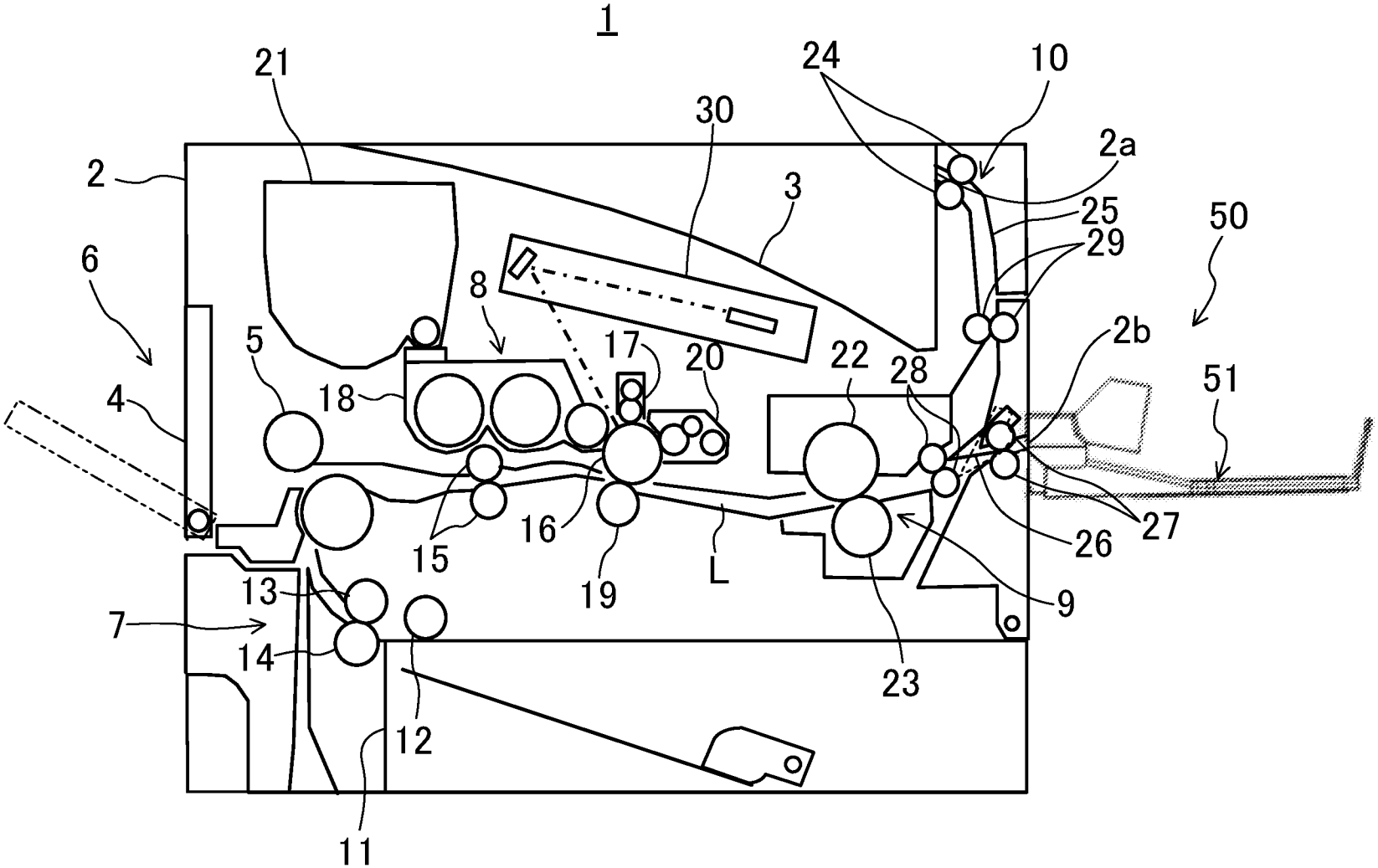
FIG. 1 is a schematic diagram illustrating an image forming apparatus mounted with a sheet discharge tray in an embodiment.
Figure 2:
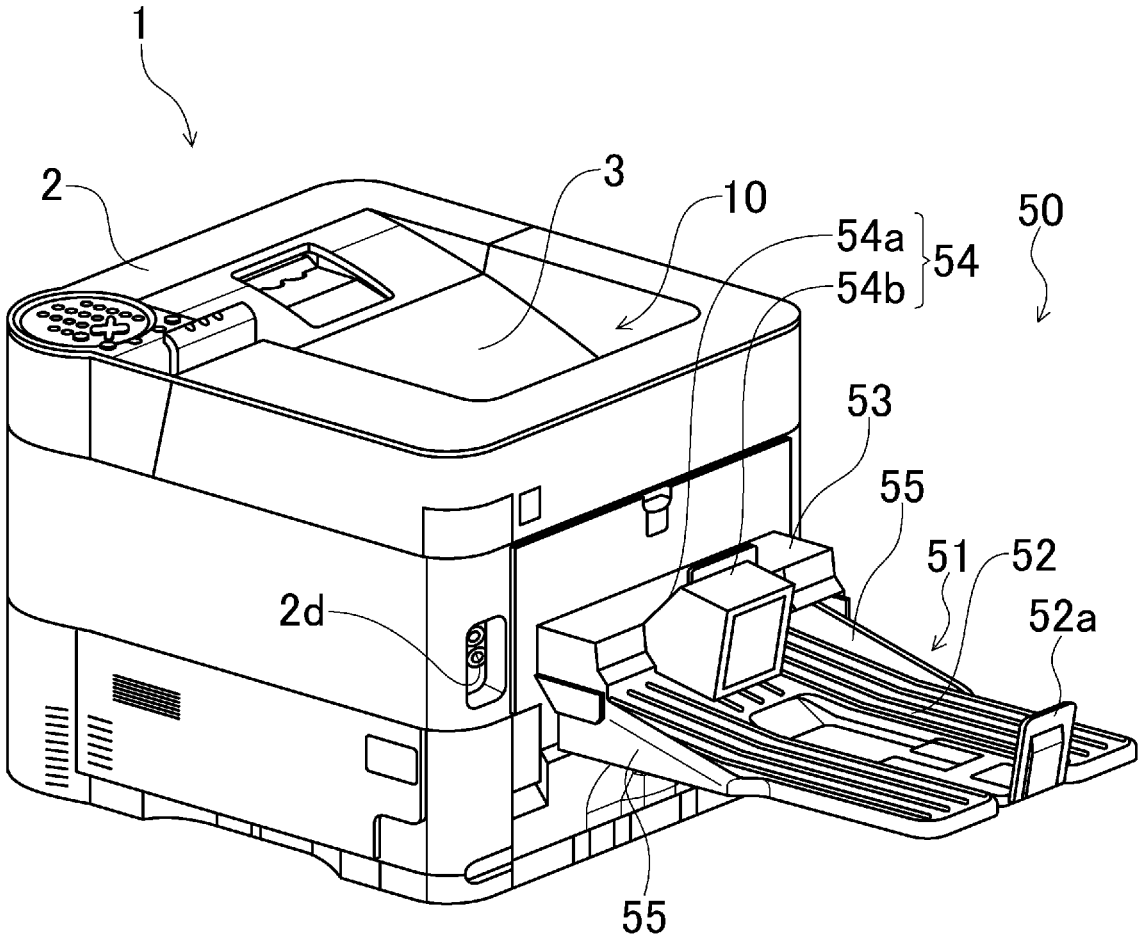
FIG. 2 is an external appearance perspective view illustrating a state in which a sheet discharge tray is mounted at an image forming apparatus.
Figure 3:
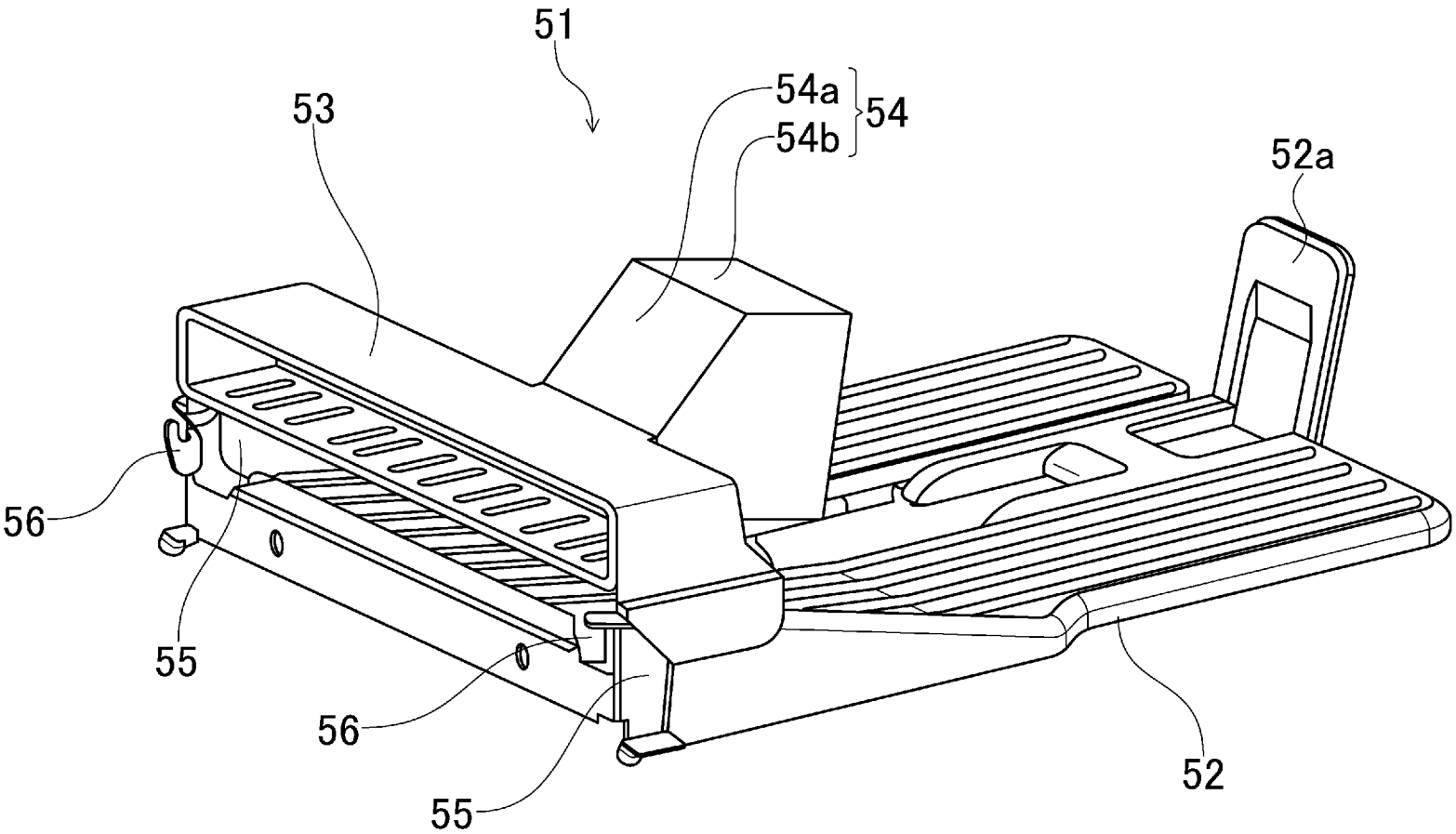
FIG. 3 is an external appearance perspective view illustrating a sheet discharge tray.

FIG. 1 is a sectional view illustrating a schematic configuration of a laser printer 1 which is an example of an image forming apparatus mounted in the present embodiment.

As illustrated in FIG. 1, the laser printer 1 includes a box-like printer body 2 (an image forming apparatus body), a manual sheet feeding unit 6, a cassette sheet feeding unit 7, an image forming unit 8, a fixing unit 9, a first sheet discharge unit 10, and a second sheet discharge unit 50. The laser printer 1 is configured to convey a sheet along a conveyance path L in the printer body 2 and form an image on the sheet on the basis of image data transmitted from a terminal and the like (not illustrated).

the manual sheet feeding unit 6 has a manual tray 4 provided at one side part of the printer body 2 so as to be openable and closable, and a manual sheet feeding roller 5 rotatably provided in the printer body 2.

The cassette sheet feeding unit 7 is provided at a bottom of the printer body 2. The cassette sheet feeding unit 7 includes a sheet feeding cassette 11 that stores a plurality of sheets overlapped one another, a pick roller 12 that takes out the sheets in the sheet feeding cassette 11 one by one, and a feed roller 13 and a retard roller 14 that separate the taken-out sheets one by one and send the separated paper to the conveyance path L.

The image forming unit 8 is provided above the cassette sheet feeding unit 7 in the printer body 2. The image forming unit 8 includes a photosensitive drum 16 rotatably provided in the printer body 2 to serve as an image carrying member, a charging device 17, a developing unit 18, a transfer roller 19, a cleaning unit 20, an optical scanning device 30, and a toner hopper 21. The charging device 17, the developing unit 18, the transfer roller 19, and the cleaning unit 20 are disposed around the photosenstive drum 16, and the optical scanning device 30 and the toner hopper 21 are disposed above the photosenstive drum 16. By so doing, the image forming unit 8 is configured to form an image on the sheet supplied from the manual sheet feeding unit 6 or the cassette sheet feeding unit 7.

On the conveyance path L, a pair of resist rollers 15 are provided to temporarily keep the sent sheet waiting and supply the sheet to the image forming unit 8 at a predetermined timing.

The fixing unit 9 is disposed at a lateral side of the image forming unit 8. The fixing unit 9 includes a fixing roller 22 and a pressure roller 23 which rotate in press-contact with each other. By so doing, the fixing unit 9 is configured to fix a toner image, which has been transferred to a sheet in the image forming unit 8, to the sheet. At a downstream side of the fixing unit 9, a switching guide 26 is provided to switch a sheet conveyance destination to either of the first sheet discharge unit 10 or the second sheet discharge unit 50.

The first sheet discharge unit 10 is provided above the fixing unit 9. The first sheet discharge unit 10 includes a sheet discharge tray 3 formed by recessing an upper part of the printer body 2 in a concave shape, a sheet discharge port 2*a* formed in a vertical wall adjacent to the sheet discharge tray 3, a sheet discharge roller pair 24 provided in the vicinity of the sheet discharge port 2*a* to convey a sheet to the sheet discharge tray 3, and a plurality of conveying guide ribs 25 that guide the sheet to the sheet discharge roller pair 24. On a conveyance path from the fixing unit 9 to the sheet discharge roller pair 24, a conveying roller pair 28 and a conveying roller pair 29 are provided.

The second sheet discharge unit 50 includes a sheet discharge port 2*b* formed in a right side surface of the printer body 2, a sheet discharge tray 51 that accepts a sheet discharged from the sheet discharge port 2*b*, and a sheet discharge roller pair 27 provided in the vicinity of the sheet discharge port 2*b* to discharge a sheet toward the sheet discharge tray 51. The aforementioned switching guide 26 is rotatably supported to a shaft of one of rollers constituting the sheet discharge roller pair 27.

When the laser printer 1 receives image data, the photosensitive drum 16 is rotationally driven and the charging device 17 electrifies a surface of the photosensitive drum 16 in the image forming unit 8.

On the basis of the image data, laser light is emitted from the optical scanning device 30 to the photosensitive drum 16. The laser light is irradiated, so that an electrostatic latent image is formed on the surface of the photosensitive drum 16. The electrostatic latent image formed on the photosensitive drum 16 is developed in the developing unit 18 and becomes a visible image as a toner image.

Thereafter, the sheet passes through between the transfer roller 19 and the photosensitive drum 16. In this case, by a transfer bias applied to toner by the transfer roller 19, the toner image on the photosensitive drum 16 is moved and transferred to the sheet. The sheet with the transferred toner image is heated and pressed by the fixing roller 22 and the pressure roller 23 in the fixing unit 9. As a consequence, the toner image is fixed to the sheet.

The laser printer 1 has a plain sheet print mode and a heavy sheet print mode as a print mode. In the plain sheet print mode, printing is performed on a plain sheet supplied to the image forming unit 8 from the cassette sheet feeding unit 7, and then the printed plain sheet is discharged to the first sheet discharge unit 10. On the other hand, in the heavy sheet print mode, printing is performed on a heavy sheet such as a postcard supplied to the image forming unit 8 from the manual tray 4, and then the printed heavy sheet is discharged to the second sheet discharge unit 50 (the sheet discharge tray 51). Switching of a sheet conveyance path due to a change in the mode is performed by the aforementioned switching guide 26. The switching guide 26 is driven by a motor (not illustrated) controlled by a control unit. The switching guide 26 is positioned at a first position indicated by a broken line of FIG. 1 in the plain sheet print mode and is positioned at a second position indicated by a solid line of FIG. 1 in the heavy sheet print mode. In the heavy sheet print mode, since the conveyance path has approximately a linear shape, it is possible to prevent the heavy sheet from curling when the heavy sheet passes through the conveyance path. It is noted that in the heavy sheet print mode, since toner is less likely to be fixed as compared with the plain sheet, a fixing temperature in the fixing unit 9 is set to be high.

Next, with reference to FIG. 2 to FIG. 5, details of the sheet discharge tray 51 will be described. The sheet discharge tray 51 has a tray body 52, a flat duct part 53, and a suction duct part 54.

Figure 6:
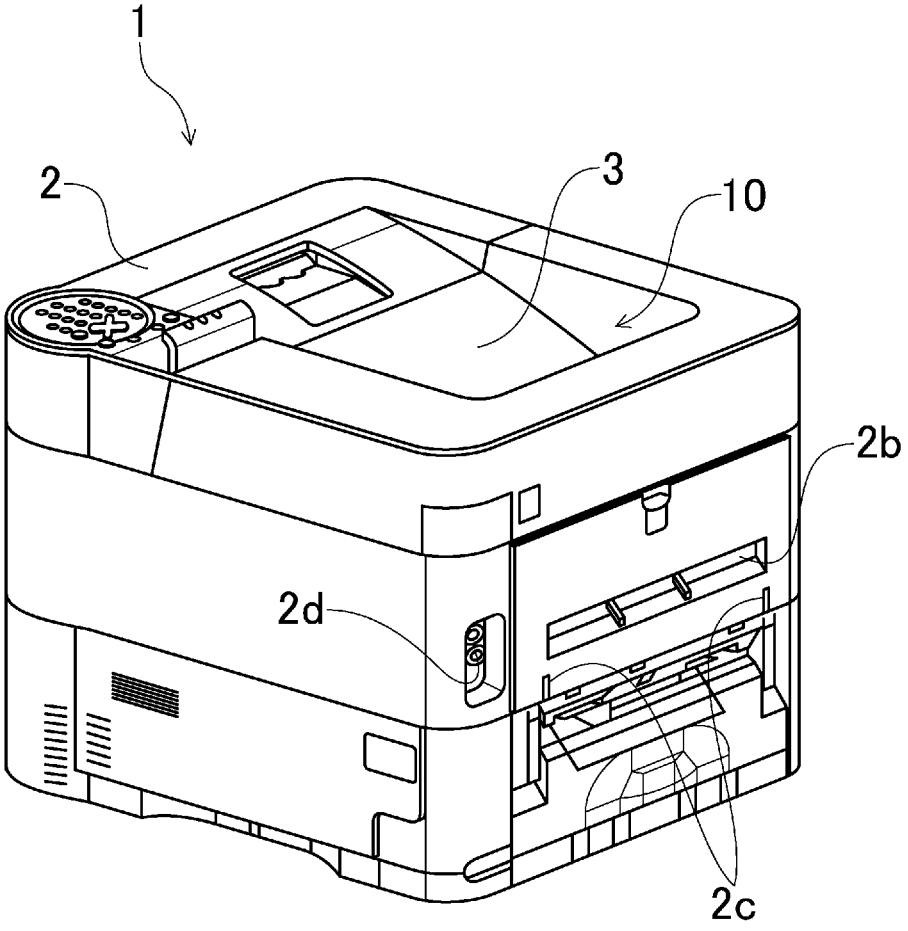
FIG. 6 is an external appearance perspective view illustrating a state in which a sheet discharge tray is detached from an image forming apparatus.

The tray body 52 has a rectangular shape long in a sheet discharge direction in a plan view. A stopper 52*a* is concatenated to a downstream side end of the tray body 52 in the sheet discharge direction to prevent falling-off of a sheet. Sidewalls 55 are vertically installed at both end edges in a wide direction of the tray body 52 at an upstream side end of the tray body 52 in the sheet discharge direction. From an upstream end surface of the pair of sidewalls 55 in the sheet discharge direction, engaging hooks 56 (see FIG. 3) protrude, wherein each of the engaging hooks 56 has an approximately L shape in a side view. The engaging hooks 56 are inserted into and hooked to a pair of engaging holes 2*c* (see FIG. 6) formed in a right side surface of the printer body 2, so that the sheet discharge tray 51 is mounted at the right side surface of the printer body 2.

The flat duct part 53 has a rectangular shape long in a sheet width direction (a direction perpendicular to the sheet discharge direction) in the plan view. The flat duct part 53 is disposed across the aforementioned pair of sidewalls 55. An upstream side opening of the flat duct part 53 is formed to surround the sheet discharge port 2*b* formed in the right side surface of the printer body 2. By so doing, a space in the flat duct part 53 communicates with the sheet discharge port 2*b* to form the sheet discharge path.

The flat duct part 53 is formed in a lower surface thereof with a discharge port 53*a* (see FIG. 4) that discharges a sheet, which is led into the flat duct part 53 from the sheet discharge port 2*b*, to the tray body 52. The flat duct part 53 is provided therein with a plurality of triangular plate-like guide plates 53*b* that guide the sheet led into the flat duct part 53 to the discharge port 53*a*. A lower end surface of each guide plate 53*b* is inclined downward toward a downstream side from an upstream side in the sheet discharge direction.

The suction duct part 54 is connected to a downstream side end (a side end opposite to the printer body 2 side) of the flat duct part 53. A remaining part, other than a part to which the suction duct part 54 is connected, of the downstream side end of the flat duct part 53 in the sheet discharge direction, is closed.

Figure 4:
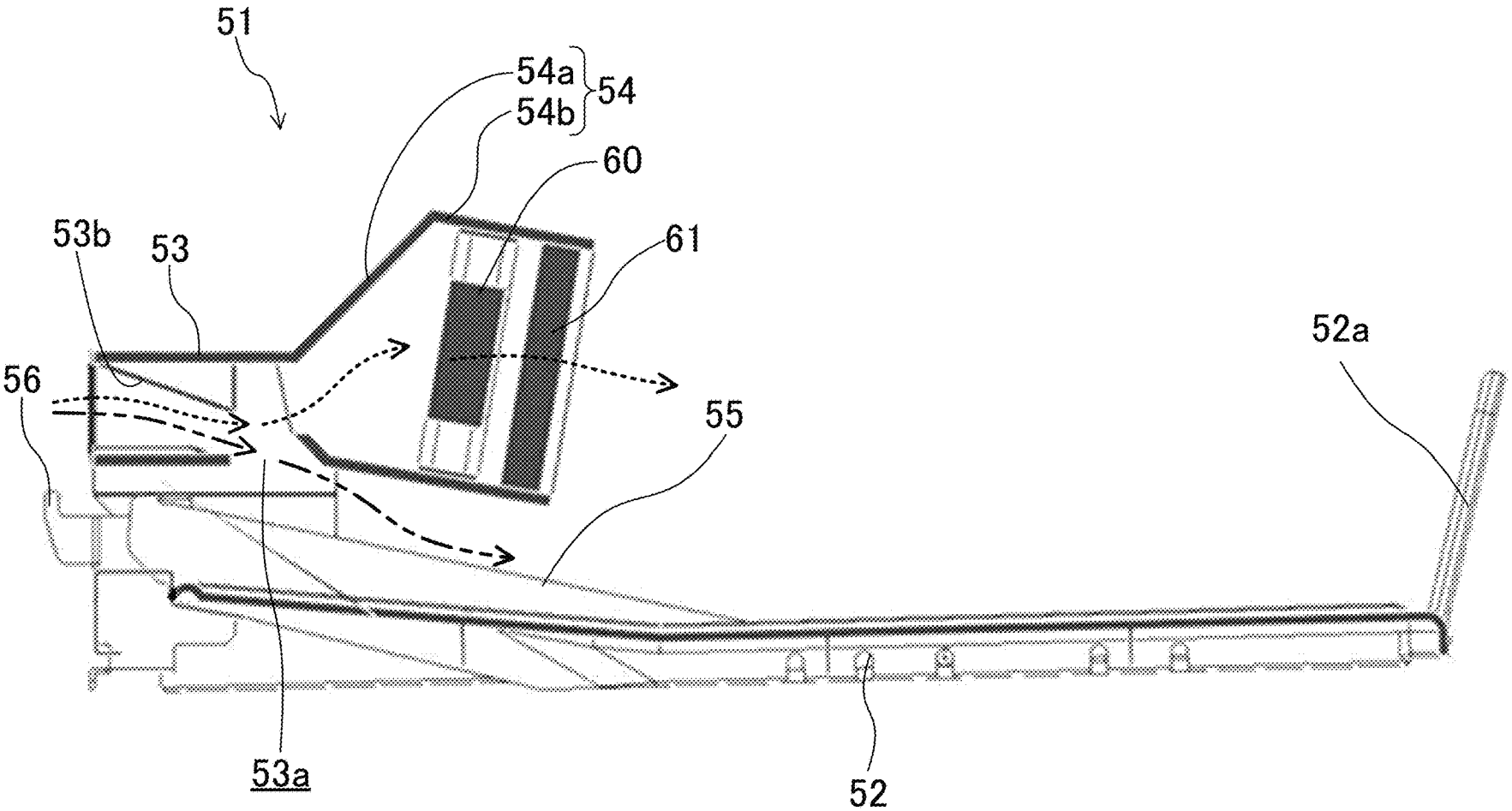
FIG. 4 is a sectional view when a sheet discharge tray is taken along section in a sheet conveyance direction.
Figure 5:
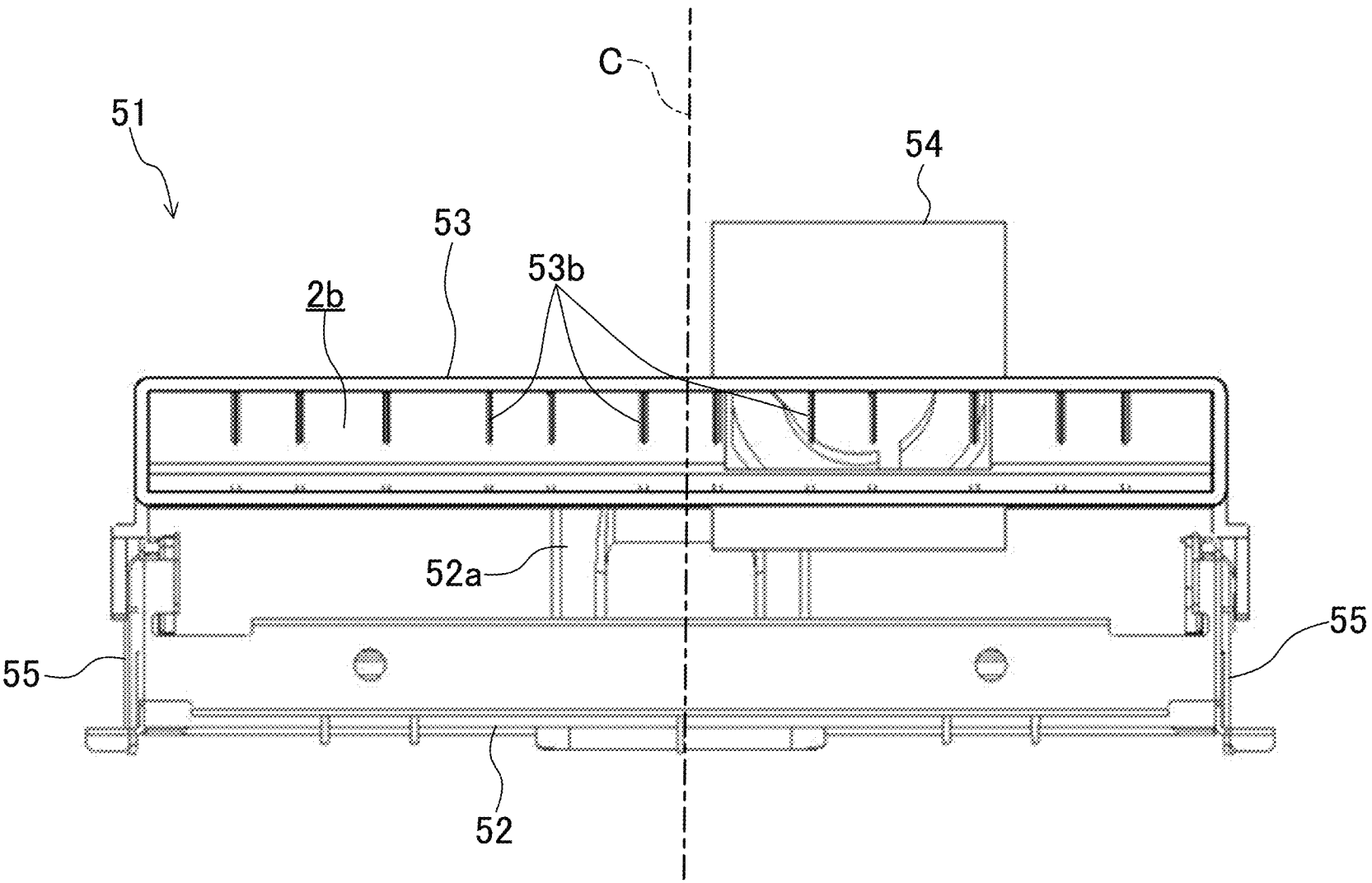
FIG. 5 is a sectional view when a section taken along a connection surface between a sheet discharge tray and a printer body is viewed from a printer body side.

The suction duct part 54 is disposed at one side from a center position C of the tray body 52 in the width direction (see FIG. 5). The suction duct part 54 has a tapered duct part 54*a* (see FIG. 4) and a rectangular duct part 54*b*. The rectangular duct part 54*b* receives a suction fan 60 and a deodorization filter 61 therein. A height of the aforementioned rectangular duct part 54*b* is higher than that of the flat duct part 53. The tapered duct part 54*a* is a part that connects the flat duct part 53 and the rectangular duct part 54*b* to each other. The tapered duct part 54*a* is formed such that its sectional area is gradually increased toward the rectangular duct part 54*b* side from the flat duct part 53 side.

The aforementioned suction fan 60 is connected to a USB terminal 2*d* provided to the right side surface of the printer body 2 via a USB power cable. The deodorization filter 61 is disposed at a downstream side of the suction fan 60. The deodorization filter 61 is a filter for removing an odor generated in the fixing unit 9 and is disposed over the whole section of the rectangular duct part 54*b*.

In the image forming apparatus 1 configured as described above, when the sheet discharge tray 51 is mounted at the right side surface of the printer body 2 and the suction fan is connected to the USB terminal 2*d*, the suction fan 60 operates, so that air in the printer body 2 is sucked inside the flat duct part 53 from the sheet discharge port 2*b*. The sucked air is almost discharged out of the apparatus by passing through the deodorization filter 61 as indicated by a broken line of FIG. 4. Consequently, an odor generated when the fixing unit 9 reaches a high temperature can be removed by the deodorization filter 61.

Furthermore, when the suction fan 60 operates, high temperature air in the printer body 2 is discharged out of the apparatus, so that it is possible to reduce the temperature of the printer body 2. Thus, it is possible to prevent the occurrence of fusion of toner due to a contact of a sheet immediately after fixing with a sheet conveyance path wall.

On the other hand, a sheet discharged from the sheet discharge port 2*b* is led into the flat duct part 53, and then is discharged onto the tray body 52 from the discharge port 53*a* by the guide plates 53*b* (see a two dot chain line of FIG. 4). In this case, the sheet is cooled by airflow flowing through the flat duct part 53. Consequently, it is possible to prevent the sheet discharged onto the tray body 52 from reaching a high temperature.

Furthermore, the aforementioned suction fan 60 is not fixed inside the printer body 2 and is integrally formed with the detachable sheet discharge tray 51. Consequently, only a user, who feels uncomfortable with an odor discharged from the fixing unit 9, uses the sheet discharge tray 51 provided with such a suction fan 60, so that it is possible to prevent an unnecessary increase in the production cost.

Furthermore, in the present embodiment, the suction duct part 54 formed in the sheet discharge tray 51 is disposed at one side from the center position of the tray body 52 in the sheet width direction (the direction perpendicular to the sheet discharge direction). Consequently, when printing is performed on a sheet such as a postcard having a relatively small wide size, a sheet discharged onto the tray body 52 can be prevented from being concealed at a lower side of the suction duct part 54 and from not being taken out.

Furthermore, in the present embodiment, the sheet discharge tray 51 is used in the heavy sheet print mode. In the heavy sheet print mode, since the fixing temperature in the fixing unit 9 is higher than that in the plain sheet print mode, the generation of an odor from the fixing unit 9 and the adhesion of toner are particularly easy to occur. Thus, in the heavy sheet print mode, the technology of the present disclosure is particularly useful.

Other Embodiments

In the aforementioned embodiment, the deodorization filter 61 is disposed at the downstream side of the suction fan 60; however, the technology of the present disclosure is not limited thereto and the deodorization filter 61 may be disposed at the upstream side of the suction fan 60.

Furthermore, in the aforementioned embodiment, an example, in which the image forming apparatus mounted with the sheet discharge tray 51 is the laser printer 1, has been described; however, the technology of the present disclosure is not limited thereto and the image forming apparatus may include a copy machine, a facsimile, a multifunctional peripheral (MFP) and the like.

What is claimed is:

1. A sheet discharge tray including a tray body mounted at a side surface of an image forming apparatus body at a position lower than a sheet discharge port formed in the side surface, and accepting a sheet discharged from the sheet discharge port, the sheet discharge tray comprising:

a flat duct part provided at an upper side of the tray body, the flat duct part surrounding the sheet discharge port and protruding toward a downstream side in a sheet discharge direction from the side surface of the image forming apparatus body, and the flat duct part forming a sheet discharge path communicating with the sheet discharge port and having at a lower surface thereof a discharge port through which the sheet is discharged;

a suction duct part connected to a downstream side end of the flat duct part in the sheet discharge direction;

a suction fan provided in the suction duct part to suck air in the image forming apparatus body through the sheet discharge port and the flat duct part, and to discharge the air through a downstream side end of the suction duct part in the sheet discharge direction; and a deodorization filter provided in the suction duct part.

2. The sheet discharge tray of claim 1, wherein the flat duct part has a guide plate provided therein, the guide plate guiding the sheet discharged through the sheet discharge port to the discharge port formed in the lower surface of the flat duct part.

3. The sheet discharge tray of claim 1, wherein the suction duct part is disposed at one side of a center position of the tray body in a sheet width direction perpendicular to the sheet discharge direction.

4. The sheet discharge tray of claim 1, wherein the tray body has sidewalls vertically installed at both end edges thereof in a sheet width direction perpendicular to the sheet discharge direction, and wherein the flat duct part is fixed to extend between the sidewalls.

5. The sheet discharge tray of claim 1, wherein the suction duct part has a dimension in a sheet width direction perpendicular to the sheet discharge direction smaller than a dimension in the sheet width direction of the flat duct part.

6. The sheet discharge tray of claim 1, wherein the suction fan is configured to be operable by being electrically connected through a power cable to a connecting terminal provided at the side surface of the image forming apparatus body.

* * * * *